US007493735B2

(12) United States Patent
Yin

(10) Patent No.: US 7,493,735 B2
(45) Date of Patent: Feb. 24, 2009

(54) SPIRAL STIRRUP AND STEEL ELEMENT COMBINATION STRUCTURE SYSTEM

(75) Inventor: Samuel Yin, Taipei (TW)

(73) Assignee: Runhorn Pretech Engineering Co., Ltd, Taipei (TW)

( * ) Notice: Subject to any disclaimer, the term of this patent is extended or adjusted under 35 U.S.C. 154(b) by 394 days.

(21) Appl. No.: 11/218,426

(22) Filed: Sep. 6, 2005

(65) Prior Publication Data

US 2006/0207211 A1 Sep. 21, 2006

(30) Foreign Application Priority Data

Mar. 18, 2005 (TW) ..... 94204190 U

(51) Int. Cl.
*E04H 12/00* (2006.01)

(52) U.S. Cl. ..... 52/649.4; 52/649.2; 140/92.5

(58) Field of Classification Search ..... 52/649.2, 52/649.3, 649.4, 649.6, 721.3, 730.2; 405/239; 140/92.5, 92.6, 92.7, 92.94
See application file for complete search history.

(56) References Cited

U.S. PATENT DOCUMENTS 1,708,277 A * 4/1929 Martin ..... 52/649.4
1,874,157 A * 8/1932 Bauer ..... 52/283
2,074,320 A * 3/1937 Bauer ..... 52/649.6
3,501,920 A * 3/1970 Minoru ..... 405/256
4,467,583 A * 8/1984 Hasak ..... 52/649.4
5,379,562 A * 1/1995 Hohmann ..... 52/295
5,542,785 A * 8/1996 Cloud ..... 52/649.4
6,244,014 B1 * 6/2001 Barmakian ..... 52/736.3
6,860,077 B2 3/2005 Yin

FOREIGN PATENT DOCUMENTS

JP 4-185811 * 7/1992

* cited by examiner

*Primary Examiner*—Richard E Chilcot, Jr.
*Assistant Examiner*—Anthony N Bartosik
(74) *Attorney, Agent, or Firm*—Muncy, Geissler, Olds & Lowe, PLLC

(57) ABSTRACT

A structure system for use in a construction is provided. The structure system has a steel element, a first spiral stirrup, and a second spiral stirrup. The first spiral stirrup forms a plurality of pitches and axially wraps at least a portion of the steel element. The second spiral stirrup is axially disposed on an outer side of the steel element. The second spiral stirrup selectively passes through the pitch and extends into an inner space of the first spiral stirrup. In addition, a plurality of axial reinforcing bars may be entered to serve special needs of structure design.

10 Claims, 6 Drawing Sheets

SPIRAL STIRRUP AND STEEL ELEMENT COMBINATION STRUCTURE SYSTEM

This application claims priority based on a Taiwanese patent application No. 094204190 filed on Mar. 18, 2005.

BACKGROUND OF THE INVENTION

1. Field of the Invention

The present invention relates generally to a structure system of construction engineering. Particularly, the present invention relates to a structure system of construction engineering which is used as a framework and followed by molding and grouting to form a construction.

2. Description of the Prior Art

Following the rise of building structure safety requirement, steel reinforced concrete (SRC) structure system has been widely used in various kinds of constructions. Engineers in this art are continuously seeking for more effective way to assemble and accomplish the SRC structure system.

In a SRC structure system, steel beams are main elements for bearing loading, tension, and shear force. Reinforcing bars and stirrups are assembled around the steel beams to share the forces on the steel beams, maintain the cohesion of the concrete, and reduce the lateral vibration. The design and application of the reinforcing bars and stirrups nowadays, however, are relatively simple and therefore do not meet the demand of structure design.

SUMMARY OF THE INVENTION

It is an object of the present invention to provide a construction structure system for use as a framework of a construction.

It is another object of the present invention to provide a construction structure system which is easily assembled.

It is a further object of the present invention to provide a construction structure system allowing various structure design options.

It is yet another object of the invention to provide a construction structure system which may form various different structure cross-section shapes.

The present invention achieves these and other objectives by providing a construction structure system having a steel beam structure, a first spiral stirrup, and a second spiral stirrup. The first spiral stirrup forms a plurality of pitches and axially wraps at least a portion of the steel beam structure. The second spiral stirrup is axially disposed on an outer side of the steel beam structure.

In a preferred embodiment, the second spiral stirrup passes through the pitch and extends into an inner space of the first spiral stirrup. In a different embodiment, however, the second spiral stirrup may be positioned on an outer side of the first spiral stirrup without passing through the pitches. In addition, in different embodiments, a plurality of axial reinforcing bars may be entered to serve special needs of structure design.

DETAILED DESCRIPTION OF THE PREFERRED EMBODIMENT

The present invention provides a structure system of construction engineering. In a preferred embodiment, the structure system is used as a framework and followed by molding and grouting to form a construction. The molding and grouting process may be accomplished either in site or in a pre-cast factory.

Figure 1:
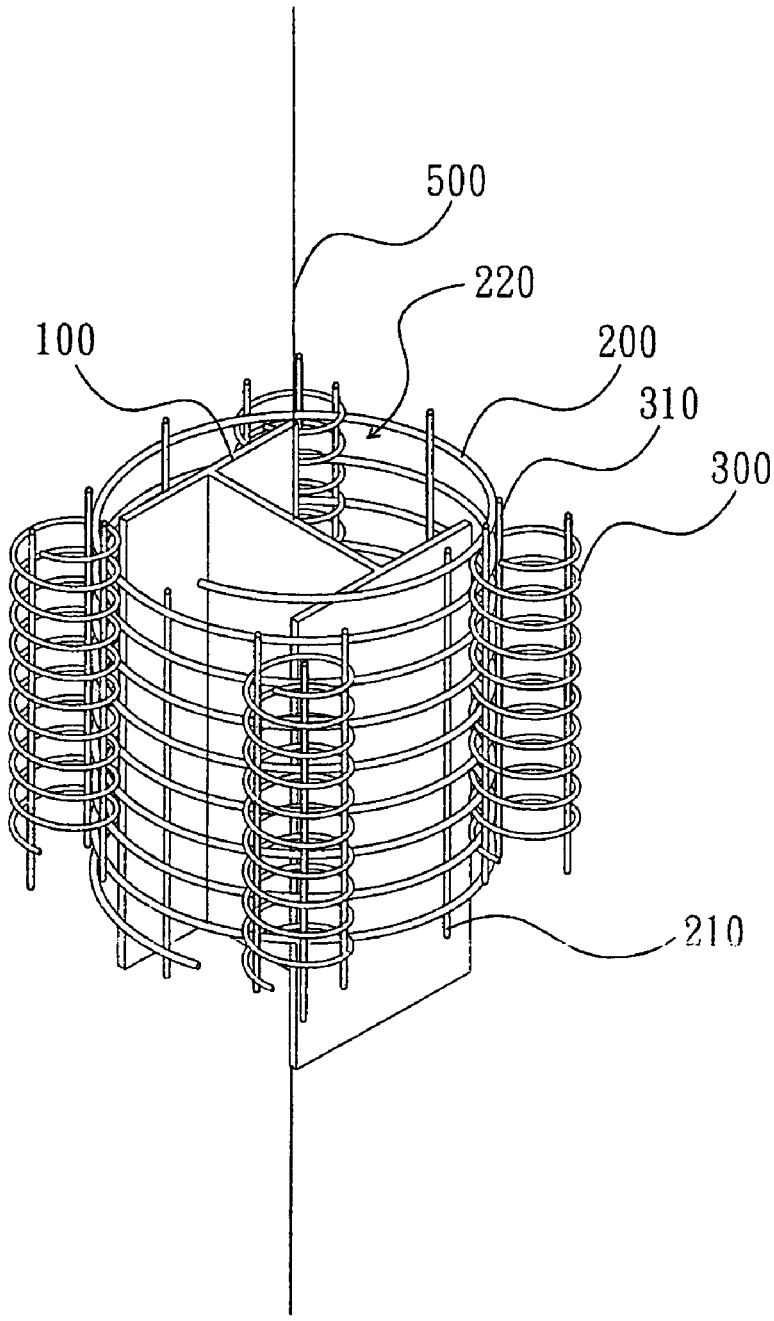
FIG. 1 is a perspective view of one embodiment of the construction structure system of the present invention.
Figure 2:
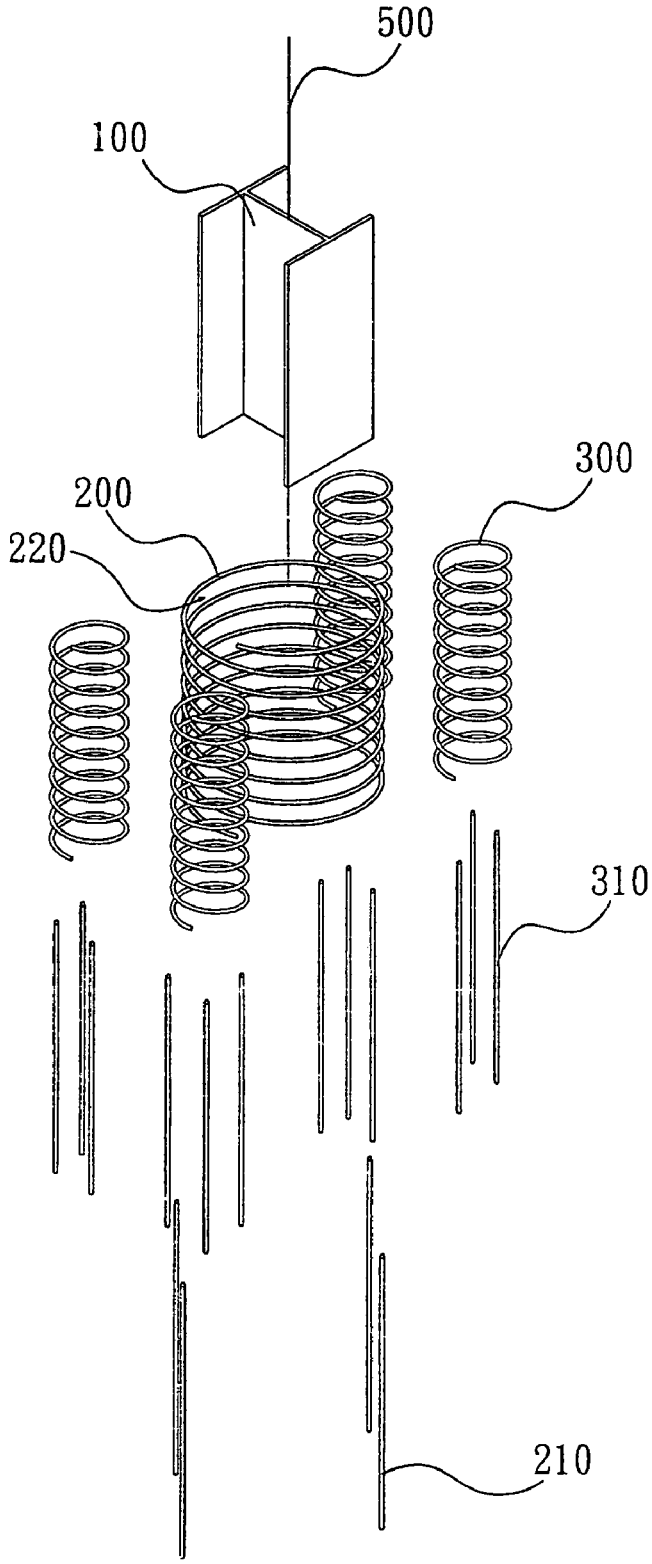
FIG. 2 is an explosive view of the embodiment of FIG. 1.

FIG. 1 and FIG. 2 illustrate a preferred embodiment of the present invention. The structure system of the present invention includes a steel beam structure 100, a first spiral stirrup 200, and a second spiral stirrup 300. The steel beam structure 100 may include various kinds of rigid metal structure, and the steel beam structure preferably has a cross section having a geometric center. In this embodiment, the steel beam structure 100 includes a steel I-beam. In different embodiments as shown in FIG. 3*a* to FIG. 3*d*, however, the steel beam structure 100 may include a steel box beam, a steel circle-section beam, or other similar structureelements. Besides, as the embodiments shown in FIG. 3*a* to FIG. 3*d*, the distance between the geometric center and each second spiral stirrup are equal in length.

Figure 3A:
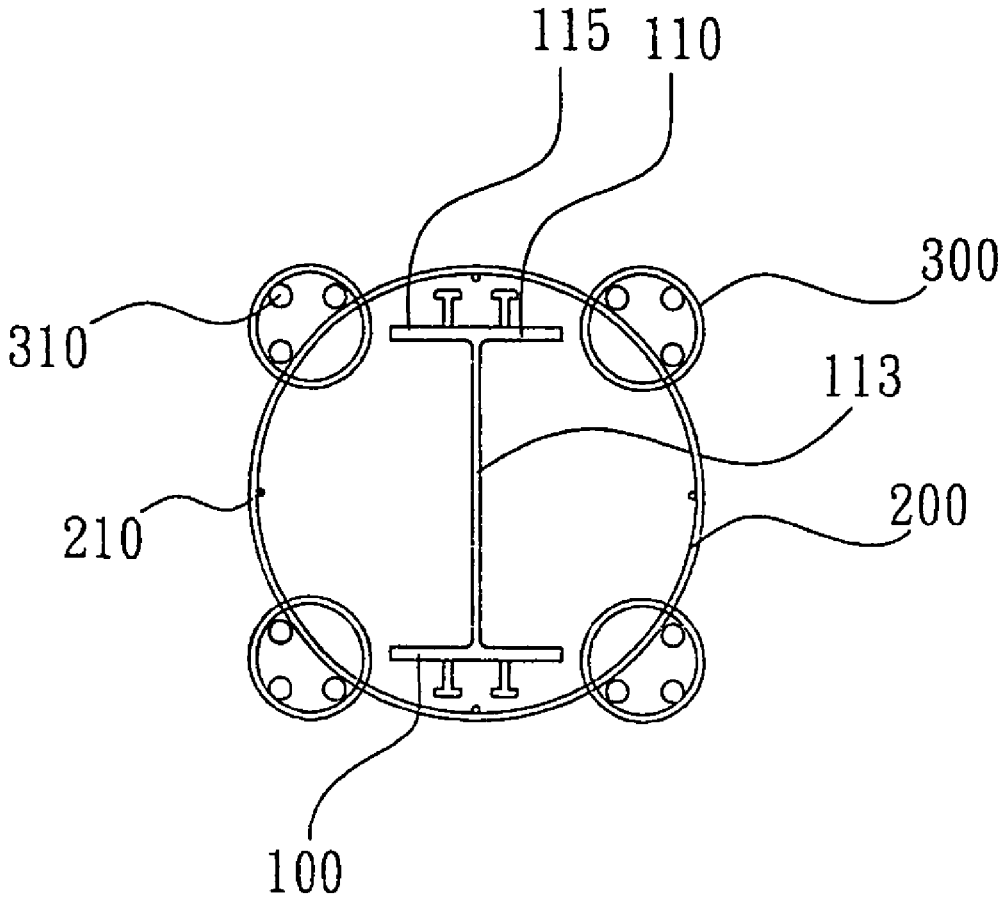
FIG. 3*a* to 3*e* show top views of several different embodiments of the construction structure system of the present invention.
Figure 3B:
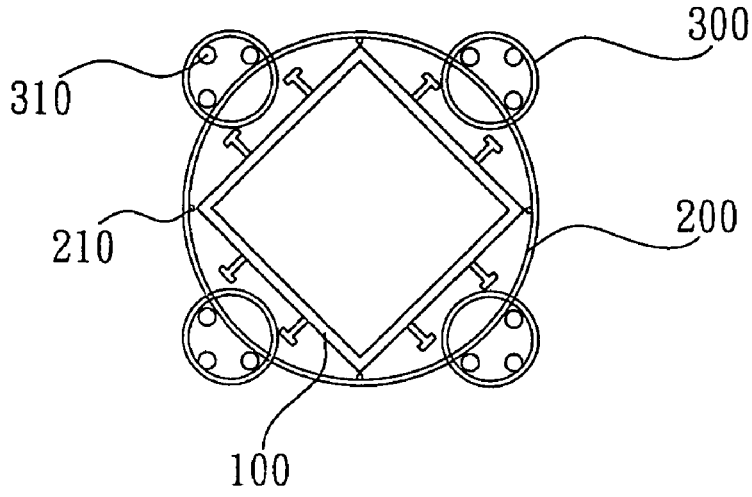
Figure 3C:
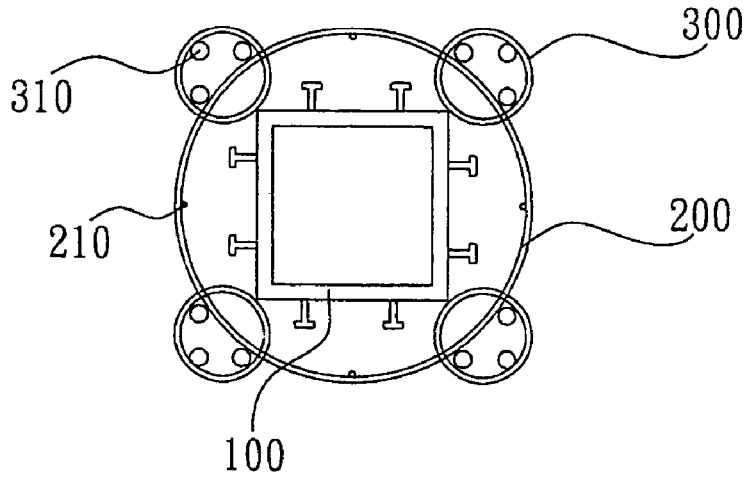
Figure 3D:
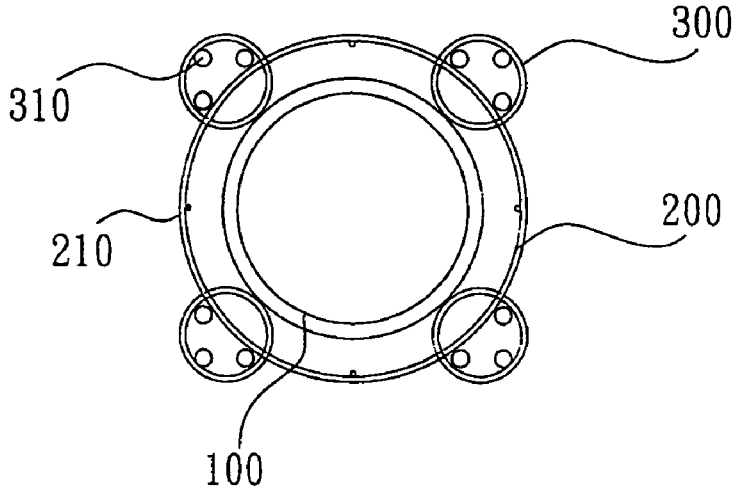
Figure 3E:
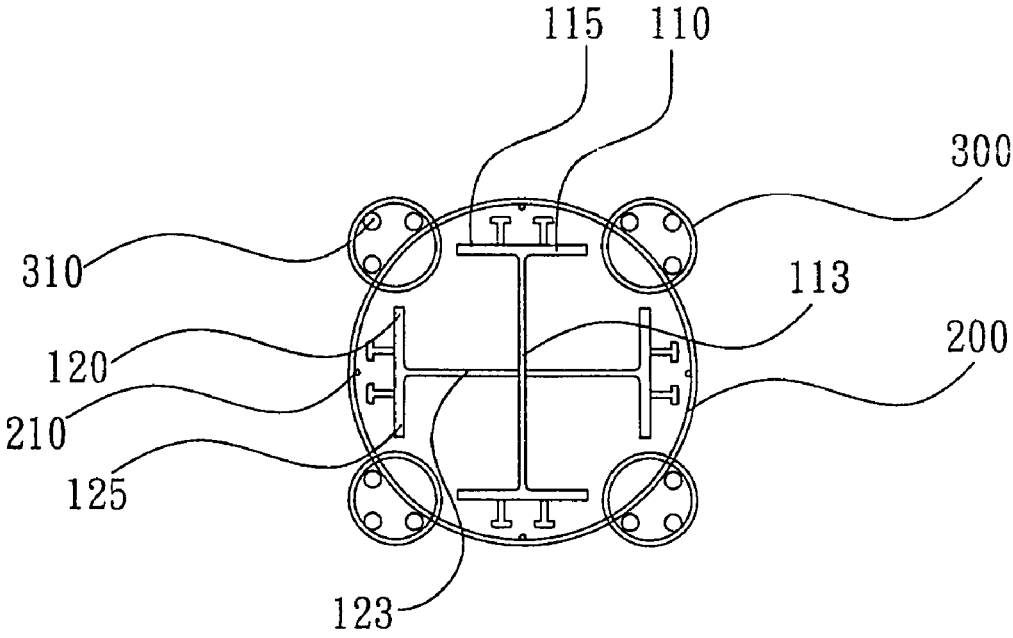

FIG. 3*e* illustrates another embodiment of the structure system of the present invention. In this embodiment, steel beam structure 100 includes a steel I-beam 110 and two steel T-beams 120. The steel I-beam 110 has a web 113 and two flanges 115. The web 115 is substantially perpendicular to and positioned between the flanges 115. The steel I-beam 120 has a web 123 and a flange 125. The flange 125 is substantially perpendicular to the web 123 and connected to a top end of the web 123. The web 123 of the steel T-beam 120 has a bottom which is connected a side surface of the web 113 of the steel I-beam 110 such that the flange 125 of the steel T-beam is substantially parallel to the web 113 of steel I-beam 110. The connection between the steel I-beam 110 and the steel T-beam 120 is preferred to be made by welding. In different embodiments, however, this connection may be achieved by bolting or other similar ways.

As FIG. 1 and FIG. 2 show, the first spiral stirrup 200 includes an axial center and forms a plurality of pitches 220. The first spiral stirrup 200 axially wraps the steel beam structure 100 such that at least a portion of the steel beam structure 100 is contained within an inner space of the first spiral stirrup 200. In a preferred embodiment, both ends of the steel beam structure 100 project from the first spiral stirrup 200 and a space exists between the beam structure and the first spiral stirrup. In different embodiments, however, the first spiral stirrup 200 may fully wrap the steel beam structure 100, or the steel beam structure 100 may expose a middle part from the first spiral stirrup 200.

In the preferred embodiment shown in FIG. 1 and FIG. 2, the first spiral stirrup 200 includes a circle spiral stirrup. In different embodiments, however, the first spiral stirrup 200 may include a rectangular spiral stirrup, an oval spiral stirrup, a polygonal spiral stirrup, or other spiral stirrup having different cross-section shape. In addition, in the preferred embodiment shown in FIG. 1 and FIG. 2, the structure system further includes a plurality of axial reinforcing bars 210. The axial reinforcing bars 210 are connected to the first spiral stirrup 200 along an axial direction 500. The axial reinforcing bars 210 and the first spiral stirrup 200 may be connected by welding, tying, other fixing methods, and the combination thereof. In a different embodiment, however, the axial reinforcing bars 210 may be eliminated.

Figure 4:
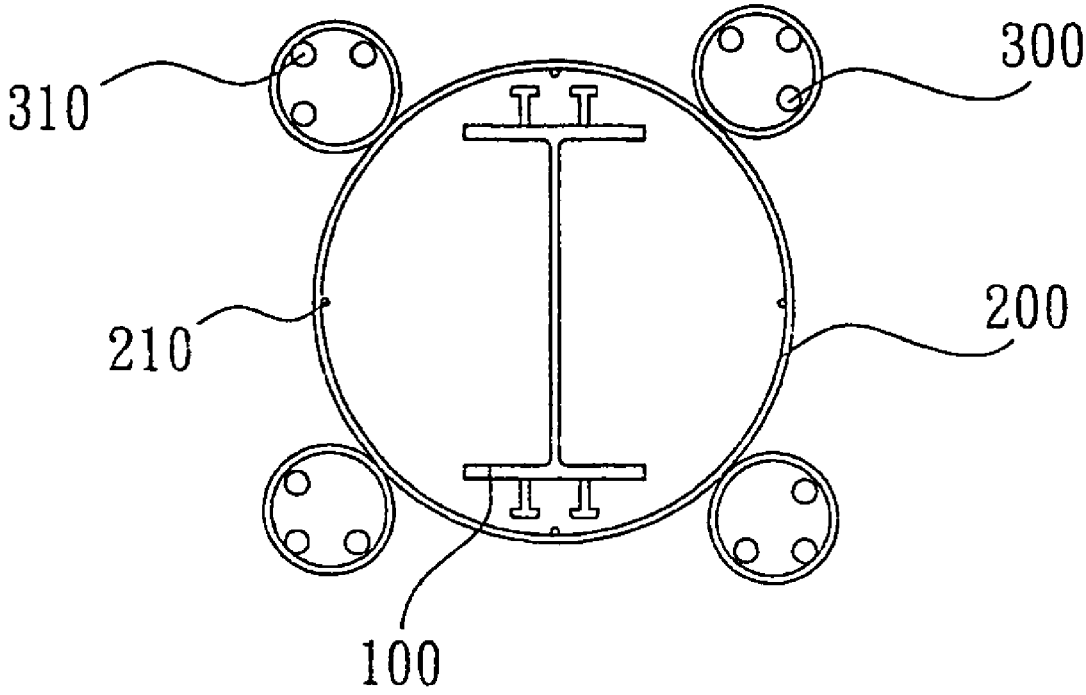
FIG. 4 is a top view of another embodiment of the present invention.

The second spiral stirrup 300 is disposed along the axial direction 500 and on an outer side of the steel beam structure 100. In the preferred embodiment shown in FIG. 1 and FIG. 2, the second spiral stirrup 300 passes through the pitches 220 and extends into the inner space of the first spiral stirrup 200 from top to toe and the axial center of the first spiral stirrup is located outside a contour of the second spiral stirrup. Taking the top view of FIG. 3*a* to FIG. 3*e*, the second spiral stirrup 300 partially overlaps the first spiral stirrup 200. However, it does not necessarily mean that a contact between the first spiral stirrup 200 and the second spiral stirrup 300 has to be made. Whether an actual contact exists between the first spiral stirrup 200 and the second spiral stirrup 300 depends on an actual demand of structure design consideration, in another embodiment of FIG. 4, the s 1cond spiral stirrup 300 is disposed on an outer side of the first spiral stirrup 200 and does not pass through the pitches 220. Therefore, in the top view of FIG. 4, the second spiral stirrup 300 does not overlap the first spiral stirrup 200, and the second spiral stirrup includes an axial center locatine outside a contour of the first spiral stirrup as well.

In the preferred embodiment shown in FIG. 1 and FIG. 2, the structure system further includes a plurality of axial reinforcing bars 310 that are connected to the second spiral stirrup 300 along an axial direction 500. In this embodiment, certain numbers of the axial reinforcing bars are connected to said first spiral stirrup symmetrically while the others are connected to said second spiral stirrup respectively. The axial reinforcing bars 310 and the second spiral stirrup 300 may be connected by welding, tying, other fixing methods, and the combination thereof. In addition, the axial reinforcing bar 310 may also connect to the first spiral stirrup 200 under special need of design consideration. In a different embodiment, however, the axial reinforcing bars 310 may be eliminated.

In the embodiment of FIG. 3*a*, the structure system of the present invention includes four sets of second spiral stirrup 300, which are corresponding to four ends of the flanges 115 of the steel I-beam 110 respectively. In different embodiments, however, the number and position of the second spiral stirrup 300 may be various depending on the actual need to form different structure cross-section shapes and loading properties. For example, in the embodiment of FIG. 3*b*, the second spiral stirrups 300 are disposed corresponding to side surfaces of the steel box beam structure 100; in another embodiment of FIG. 3*c*, however, the second spiral stirrups 300 are disposal corresponding to corners of the steel box beam structure 100.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A construction structure system, comprising:

a steel beam structure;

a first spiral stirrup axially wrapping around at least a portion of said steel beam structure, said first spiral stirrup forming a plurality of pitches, wherein an inner space exists between the beam structure and the first spiral stirrup; and at least one second spiral stirrup axially disposed on an outer side of said steel beam structure, the second spiral stirrup is separate from the first spiral stirrup, said first spiral stirrup further includes an axial center which is located outside a contour of said second spiral stirrup, said second spiral stirrup passes through said plurality of pitches and extends into the inner space of said first spiral stirrup and beam structure from top to toe.

2. The construction structure system of claim 1, wherein said second spiral stirrup is disposed on an outer side of said first spiral stirrup and the second spiral stirrup includes an axial center locating outside a contour of the first spiral stirrup.

3. The construction structure system of claim 1 further comprising a plurality of axial reinforcing bars connected to said first spiral stirrup respectively, wherein the axial reinforcing bars are parallel to the axial center.

4. The construction structure system of claim 1 further comprising a plurality of axial reinforcing bars connected to said second spiral stirrup respectively, wherein the axial reinforcma bars are parallel to the axial center.

5. The construction structure system of claim 1, wherein said steel beam structure includes a steel I-beam having a web and two flanges.

6. The construction structure system of claim 5, wherein said second spiral stirrup is juxtaposed to an end of said flange.

7. The construction structure system of claim 5, wherein said steel beam structure further includes a steel T-beam having a web and a flange, said web of said T-beam has a bottom connected to a side of said web of said I-beam.

8. The construction structure system of claim 1, wherein said steel beani structure includes a steel box beam.

9. The construction structure system of claim 1, wherein said steel beam structure includes a steel tube-shaped beam.

10. A construction structure system, comprising:

a steel beam structure, the steel beam structure has a cross section having a geometric center;

a first spiral stirrup axially wrapping around at least a portion of said steel beam structure, said first spiral stirrup forming a plurality of pitches, wherein an inner space exists between the beam structure and the first spiral stirrup;

at least one second spiral stirrups axially disposed on an outer side of said steel beam structure, the second spiral stirrup is separate from the first spiral stirrup, said first spiral stirrup further includes an axial center which is located outside a counter of said second spiral stirrup, wherein said second spiral stirrup passes through said plurality of pitches and extends into the inner space of said first spiral stirrup and beam structure from top to toe; and a plurality of axial reinforcing bars, certain numbers of the axial reinforcing bars are connected to said first spiral stirrup symmetrically while the others are connected to said second spiral stirrup respectively, wherein the axial reinforcing bars are parallel to the axial center.

* * * * *